US005610478A

United States Patent [19]

Kato et al.

[11] Patent Number: 5,610,478

[45] Date of Patent: Mar. 11, 1997

[54] METHOD OF CONDITIONING EMITTERS OF A FIELD EMISSION DISPLAY

[75] Inventors: Yumiko Kato, Mesa; Ralph Cisneros, Tempe, both of Ariz.

[73] Assignee: Motorola, Schaumburg, Ill.

[21] Appl. No.: 550,057

[22] Filed: Oct. 30, 1995

[51] Int. Cl.[6] ..... G09G 3/00

[52] U.S. Cl. ..... 315/169.1; 315/337; 313/309

[58] Field of Search ..... 315/169.1, 334, 315/337, 340; 313/309, 336, 351; 445/2, 5, 6, 59

[56] References Cited

U.S. PATENT DOCUMENTS 4,908,539 3/1990 Meyer ..... 315/169.1 X
5,189,341 2/1993 Itoh et al. ..... 315/169.1
5,223,766 6/1993 Nakayama et al. ..... 313/309 X
5,361,015 11/1994 Okunuki et al. ..... 313/309
5,453,659 9/1995 Wallace et al. ..... 313/495
5,461,009 10/1995 Huang et al. ..... 315/334 X

*Primary Examiner*—Benny Lee
*Assistant Examiner*—Justin P. Bettendorf
*Attorney, Agent, or Firm*—Eugene A. Parsons

[57] ABSTRACT

Emitters (14, 16, 17, 18) of a field emission display (10) are conditioned to improve electron emission. The emitters (14, 16, 17, 18) and the rows (21, 22) are operated at voltages that stimulate electron emission from the emitters (14, 16, 17, 18). An anode (23) is operated at a voltage that does not attract electrons so that the electrons are attracted to the rows (21, 22).

3 Claims, 2 Drawing Sheets

METHOD OF CONDITIONING EMITTERS OF A FIELD EMISSION DISPLAY

BACKGROUND OF THE INVENTION

The present invention relates, in general, to field emission devices, and more particularly, to a method of operating a field emission device.

In the past, the industry has utilized a variety of methods for operating displays that utilize field emission devices. During the assembly of a field emission device, the electron emitting elements or emitters often become contaminated. When power is applied, these contaminants react with the emitters and cause a decrease in operational efficiency. Also, when power is applied the emitters absorb gases that may be in the surrounding atmosphere thereby further lowering the emission efficiency.

One procedure directed toward minimizing the effect of such contaminants and gases is electron scrubbing. In the scrubbing procedure, electrons emitted by one emitter are attracted to a nearby emitter so that the attracted electrons scrub the nearby emitter thereby removing some of the contaminants. One problem with such a procedure is the requirement for operating the emitters at different voltages so that one emitter may emit electrons and the nearby emitter may attract the emitted electrons. In a normal operating mode, emitters are all operated at the same potential. Thus, extra electronics and interconnects are required to operate emitters at different potentials in order to perform the scrubbing procedure. This increases the complexity of a display utilizing the scrubbing procedure thereby increasing the cost of such a display.

Accordingly, it is desirable to have a method of operating a field emission display that increases the emission efficiency of the field emission elements, that does not require additional interconnect or extra electronics, and that does not increase the cost of the display.

DETAILED DESCRIPTION OF THE DRAWINGS

DETAILED DESCRIPTION OF THE DRAWINGS

Figure 1:
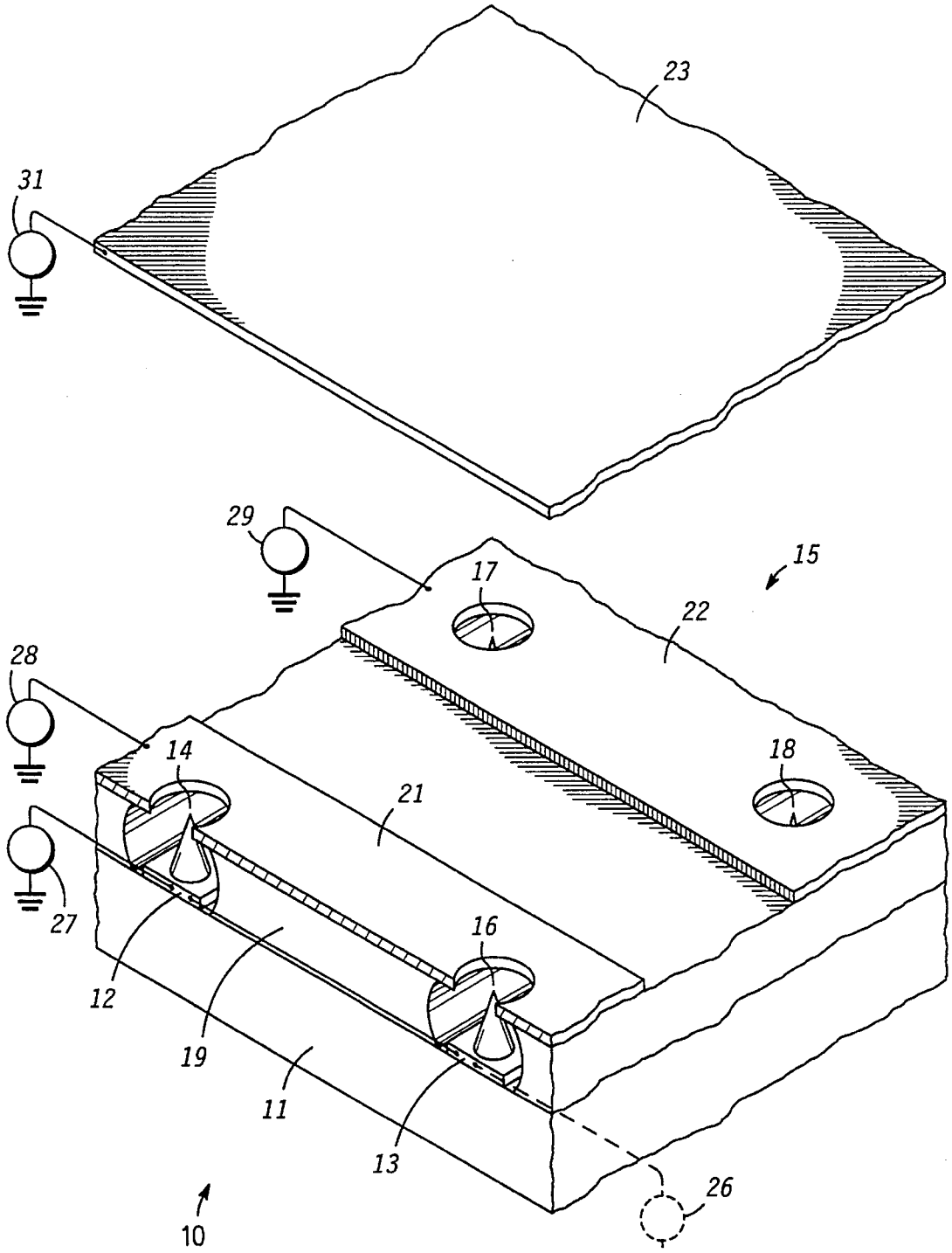
FIG. 1 illustrates an enlarge cross-sectional perspective view of a portion of a field emission display in accordance with the present invention.

FIG. 1 illustrates an enlarged cross-sectional portion of a field emission display 10. Display 10 includes an electron source sub-assembly 15 and an anode 23 that overlays sub-assembly 15. Sub-assembly 15 includes a substrate 11, for example glass, onto which other elements of sub-assembly 15 are formed. Sub-assembly 15 also includes a plurality of columns with each column including a column conductor and a plurality of field emission emitters. The plurality of columns includes a first column conductor 12 and a second column conductor 13 that are formed on substrate 11. A plurality of field emission emitters are formed on each of conductors 12 and 13 including a first field emission emitter 14 and a second field emission emitter 17 on conductor 12, and a third field emission emitter 16 and a fourth field emission emitter 18 on conductor 13. Each of the emitters 14, 17, 16, and 18 represent individual pixels of display 10. Although shown as a single emitter, for example emitter 14, pixels of a display often include an array of closely spaced emitters, for example a pixel may include forty to fifty closely spaced emitters. However, for simplicity of the illustration only one emitter, for example emitter 14, is shown for each pixel.

A dielectric 19 isolates conductors 12 and 13 along with emitters 14, 17, 16, and 18 from a plurality of rows that includes a first row 21 and a second row 22 formed on dielectric 19. Each of rows 21 and 22 are conductors that have emission openings where the conductors overlie emitters 14, 17, 16, and 18. The portion of each conductor adjacent to each emission opening is often referred to as a gate or gate electrode because it acts as a gate that either stimulates or prevents electron emission from the corresponding emitter. An anode 23 overlies substrate 11 and has a phosphor coating on the side toward sub-assembly 15. In typical operation an image is formed on anode 23 when electrons emitted from emitters 14, 17, 16, and 18 strike the phosphor coating.

Prior to operating display 10 in a typical operating mode that forms images on anode 23, display 10 is operated in a conditioning mode that improves the emission efficiency of emitters 14, 17, 16, and 18. In this conditioning mode, display 10 is operated so that electron emission is stimulated from an emitter while the gate electrode is operated at a voltage that will collect substantially all of the electrons emitted by the emitter. Anode 23 is operated at a voltage that substantially prevents attraction of the electrons emitted by the emitter. This operation improves the electron emission efficiency of display 10, that is, more electrons are emitted for a given set of emitter to gate and emitter to anode potentials. It is believed that in this conditioning mode, the emitted electrons cause contaminants to be redeposited on the gate. The contaminants remain on the gate during normal operation and do not affect the electron emission efficiency of the emitters.

Figure 2:
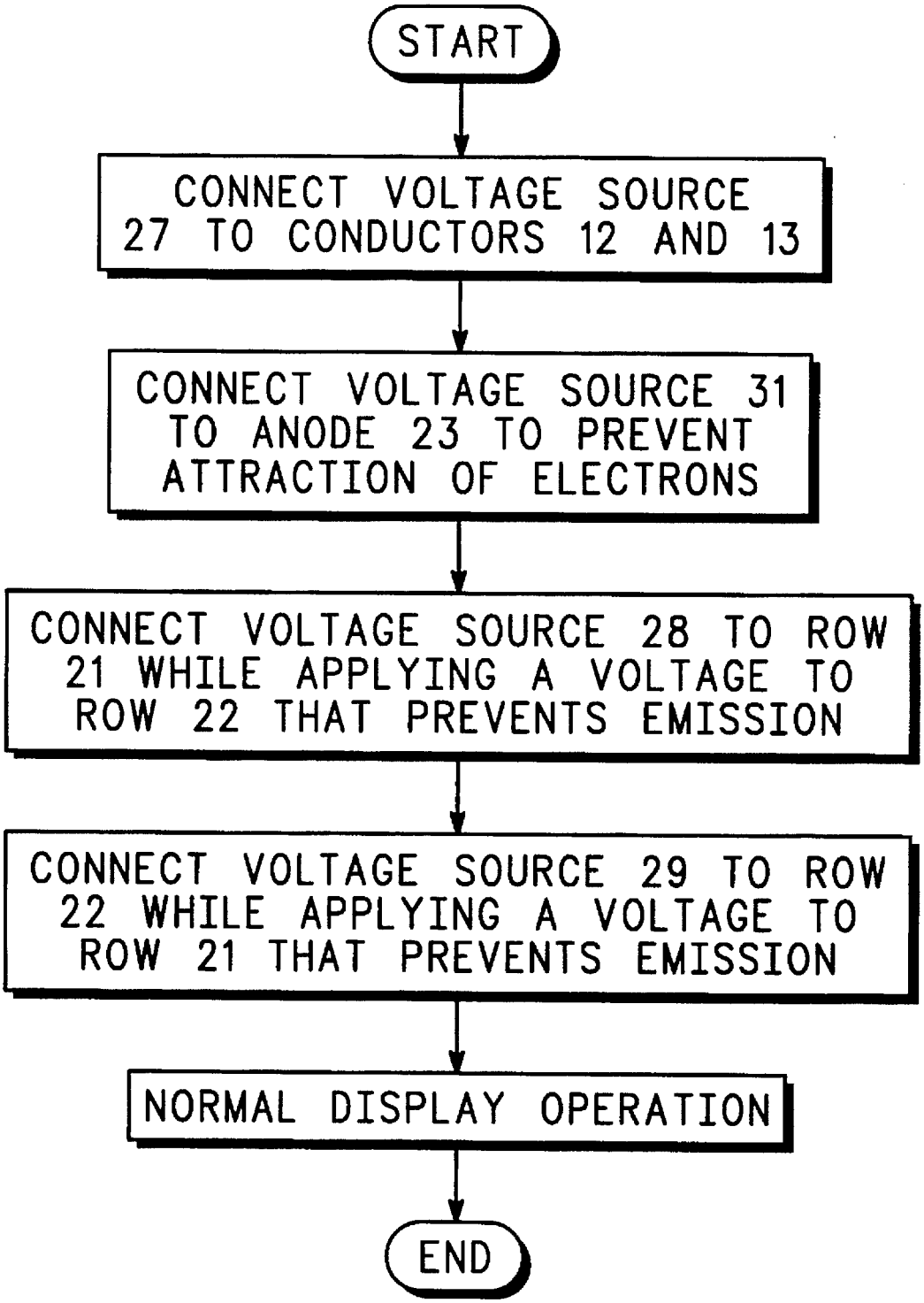
FIG. 2 illustrates a flow chart showing a method for improving the emission efficiency.

FIG. 2 illustrates a flow chart showing a method for improving the emission efficiency.

In one embodiment, the columns are connected, via conductors 12 and 13, to a first voltage source 27 so that the same voltage is applied to emitters 14, 17, 16, and 18. A second voltage source 28 and a third voltage source 29 are connected to rows 21 and 22, respectively. Sources 28 and 29 sequentially apply a second voltage to each of rows 21 and 22, respectively, in order to stimulate emission from underlying emitters. For example, source 28 applies a voltage to row 21 that stimulates emission from emitters 14 and 16 while source 29 applies a voltage to row 22 that prevents emission from emitters 17 and 18. Thereafter, source 28 applies a voltage to row 21 that prevents electron emission from emitters 14 and 16 while source 29 applies a voltage to row 22 that stimulates electron emission from emitters 17 and 18. During the periods of electron stimulation, a voltage source 31 holds anode 23 at a voltage that substantially prevents attraction of electrons emitted by emitters 14, 16, 17, and 18. This method of operating display 10 operates the columns and the rows at substantially the same voltages and operational sequence as the normal operating mode for display 10. However, anode 23 is at a potential that substantially prevents attraction of electrons. Consequently, this operation or method does not require additional electronics or interconnect in order to sequence voltages between rows and columns of display 10, thereby minimizing the manufacturing cost while improving the emission efficiency of display 10. In the preferred embodiment, sources 31 and 27 apply a ground potential to anode 23 and conductors 12 and 13, respectively, while sources 28 and 29 sequentially apply approximately fifty to one hundred volts to stimulate emission and approximately ground to prevent emission. It should be noted that source 27 could be other potentials in addition to ground as long as the emitter-to-gate potential results in electron emission.

Because the conditioning mode operates the columns and rows in the same manner as during normal operation when forming images, the conditioning mode can be alternated with normal operation. For example, the conditioning mode can be utilized each time power is applied to a display and before images are formed. Alternately, the conditioning mode can be used during blanking intervals.

In another embodiment, the column that includes conductor 13 can be connected to another voltage source 26, shown in phantom, instead of source 27. This allows emitters 14 and 17 on the first column to be conditioned independently from emitters 16 and 18 on the second column. Rows 21 and 22 can be operated sequentially or simultaneously.

In still another embodiment, source 27 applies the same potential to the columns, via conductors 12 and 13, while sources 28 and 29 both simultaneously apply a voltage that stimulates electron emission from underlying emitters. Anode 23 is again operated at a voltage that substantially prevents attraction of emitted electrons. This method allows for improving the emission efficiency of all emitters simultaneously.

By now it should be appreciated that there has been provided a novel conditioning method that improves the emission efficiency of a field emission display. By operating the display so that substantially all electrons emitted by the emitters are attracted to the gates, the emission efficiency of the display is improved. Additionally, the columns and rows can be operated at the same voltages and the same sequencing that is utilized during normal operation of the display thereby lowering the manufacturing cost of the display.

We claim:

1. A method of conditioning a field emission device to improve electron emission from a field emission display prior to operation in a normal display mode comprising:

providing a field emission display having a plurality of emitters formed into a plurality of columns and a plurality of rows;

applying a first voltage to a first column in the plurality of columns;

applying a third voltage to an anode of the field emission display wherein the third voltage substantially prevents attraction to the anode by electrons emitted from the emitters prior to the operation in the normal display mode;

applying a second voltage to a gate electrode in a first row of the plurality of rows for a predetermined time and a fourth voltage to other gate electrode in the remaining rows of the plurality of rows, wherein the second voltage stimulates emission of electrons from emitters in the first row and the fourth voltage, which is lower than the second voltage, prevents emission of electrons from emitters in the remaining rows, so that the electrons are attracted to the first row, gate electrode prior to the operation in the normal display mode and sequentially repeating the last step for each successive row in the plurality of rows.

2. The method of claim 1 wherein the first and third voltages are a ground potential.

3. The method of claim 1 wherein the second voltage is fifty to one hundred volts.

* * * * *